US009516406B2

(12) United States Patent
Fromel et al.

(10) Patent No.: US 9,516,406 B2
(45) Date of Patent: Dec. 6, 2016

(54) PORTABLE DEVICE WITH ENHANCED BASS RESPONSE

(75) Inventors: Andreas Fromel, Kirchseeon (DE); Josef Stohr, Langenau (DE)

(73) Assignee: Nokia Technologies Oy, Espoo (FI)

( * ) Notice: Subject to any disclaimer, the term of this patent is extended or adjusted under 35 U.S.C. 154(b) by 44 days.

(21) Appl. No.: 14/364,139

(22) PCT Filed: Dec. 20, 2011

(86) PCT No.: PCT/IB2011/055818

§ 371 (c)(1),
(2), (4) Date: Sep. 26, 2014

(87) PCT Pub. No.: WO2013/093552

PCT Pub. Date: Jun. 27, 2013

(65) Prior Publication Data

US 2015/0237440 A1 Aug. 20, 2015

(51) Int. Cl.
*H04R 1/00* (2006.01)
*H04R 1/22* (2006.01)

(52) U.S. Cl.
CPC . *H04R 1/22* (2013.01); *H04R 1/00* (2013.01)

(58) Field of Classification Search
CPC ..... H04R 1/00; H04R 1/22
See application file for complete search history.

(56) References Cited

U.S. PATENT DOCUMENTS 6,809,635 B1 * 10/2004 Kaaresoja ..... H04M 1/03 340/384.73
2006/0239479 A1 * 10/2006 Schobben ..... H04M 1/0266 381/306
2007/0057909 A1 3/2007 Schobben et al.
2007/0223776 A1 * 9/2007 Mellow ..... H04R 1/225 381/411
2008/0205666 A1 * 8/2008 Tanghe ..... H04S 7/30 381/98
2010/0148942 A1 6/2010 Oh et al.
2010/0220866 A1 9/2010 Hsu
2010/0226508 A1 * 9/2010 Aarts ..... H04R 3/04 381/99
2011/0029106 A1 2/2011 Isberg et al.

FOREIGN PATENT DOCUMENTS

GB 2378616 2/2003
WO 2006092746 9/2006
WO 2007049091 5/2007
WO 2007132431 11/2007
WO 2011110901 A1 9/2011

OTHER PUBLICATIONS

"Solid Drive", Sound without Speakers, Retrieved on Dec. 3, 2014, Webpage available at : http://www.soliddrive.com/index.php/products/soliddrives/.
"Transform Your Breakfast Into a Boom Box", Tunebug, Retrieved on Dec. 2, 2014, Webpage available at : http://www.tunebug.com/products/.
International Search Report received for corresponding Patent Cooperation Treaty Application No. PCT/IB2011/055818, dated Sep. 3, 2012, 5 pages.

* cited by examiner

*Primary Examiner* — Sonia Gay
(74) *Attorney, Agent, or Firm* — Harrington & Smith

(57) ABSTRACT

Apparatus comprising: at least one transducer configured to generate at least one lower frequency acoustic signal for output by a surface when in contact with the apparatus and at least one higher frequency acoustic signal for output by air conduction.

29 Claims, 8 Drawing Sheets

PORTABLE DEVICE WITH ENHANCED BASS RESPONSE

RELATED APPLICATION

This application was originally filed as PCT Application No. PCT/IB2011/055818 filed on Dec. 20, 2011.

TECHNICAL FIELD

The present application relates to a method and apparatus. In some embodiments the method and apparatus relate to portable devices such as a mobile radio terminal that have a vibration mechanism for converting audio signals into vibrations. It is particularly directed to a method and apparatus for transferring vibrations from a mobile radio terminal into a surface of external objects delivering expanded sound energy than the mobile radio terminal alone.

BACKGROUND

Some portable devices comprise integrated speakers for creating sound such as playing back music or having a telephone conversation. The loudness and bandwidth of the integrated speakers are important especially in environments where the ambient noise levels are high, even indoors. The loudness of the integrated speakers in a portable device is important for perception of ringtones of a mobile telephone. In some countries the loudness of the integrated speakers is important for listening to FM radio broadcasts.

In some parts of the world a portable device with an integrated speaker may be the only device the user owns which is capable of playing music. For example, a user may only be able to play music using a loudspeaker of a mobile telephone. The loudness and bandwidth of sound from an integrated speaker are even more important if a user is solely reliant on an integrated speaker of a portable device for music playback.

It is known to increase the loudness of integrated speakers by actively amplifying sound by electronic solutions. For example, circuitry comprising large transducers, components for signal processing and other electrical modifications has been used. Other solutions further comprise external loudspeakers. It is also common to use two speakers where their output is acoustically coupled, for example by mutual acoustic coupling, to increase the loudness. In addition, these known solutions can also improve bandwidth expansion. For example, an integrated speaker can operate in a slightly lower frequency region than its normal operation range. Typically digital signal processing (DSP) may increase loudness and/or improve bandwidth by using one or more of the following: digital gains, equalization (EQ), single or multiple dynamic range controllers (DRC) and transducer protection comprising displacement and temperature controller to prevent distortion. It is understood that there may be more additional systems or algorithms which are designed for use in digital signal processing. For example, in addition there may be and/or other systems in a playback chain such as electrical filters. Disadvantageously, the additional components are expensive and use additional power which can reduce portable device operating time dramatically.

Another technique for increasing the loudness and bandwidth of an integrated speaker is using an external accessory. One such accessory is a desk stand or a cradle for a hands free car kit which provides passive amplification for a portable device. However, external accessories providing either active or passive amplification are expensive and bulky. This means the user cannot easily transport the desk stand and has to keep it in one place. Furthermore manufacture of such external accessories is complex and requires an expensive manufacturing set up and equipment.

SUMMARY

According to a first aspect there is provided a method comprising: generating by at least one transducer within the apparatus at least one lower frequency acoustic signal for output by a surface when in contact with the apparatus and at least one higher frequency acoustic signal for output by air conduction.

The at least one transducer may be at least two transducers, and generating by at least one transducer within the apparatus at least one lower frequency acoustic signal for output by the surface in contact and at least one higher frequency acoustic signal for output by air conduction may comprise generating by a first of the at least two transducers within the apparatus at least one lower frequency acoustic signal for output by the surface in contact and by a second of the at least two transducers at least one higher frequency acoustic signal for output by air conduction The method may further comprise: determining when the apparatus loses contact with the surface; and generating by the at least one transducer at least one combination frequency acoustic signal for output by air conduction when the apparatus loses contact with the surface.

Generating at least one lower frequency acoustic signal for output by contact conduction via the surface and at least one higher frequency acoustic signal for output by air conduction may comprise: low pass filtering an input audio signal to generate the at least one lower frequency acoustic signal; and high pass filtering the input audio signal to generate the at least one higher frequency acoustic signal.

The method may further comprise determining the acoustic characteristics of the surface in contact with the apparatus, and wherein generating at least one lower frequency acoustic signal for output by the surface in contact and at least one higher frequency acoustic signal for output by air conduction may comprise generating the at least one lower frequency acoustic signal and the at least one higher frequency acoustic signal dependent on the acoustic characteristics of the surface.

Determining the acoustic characteristics of the surface in contact with the apparatus may comprise determining the delay between contact conduction and air conduction; and wherein determining the acoustic characteristics and generating the at least one lower frequency acoustic signal and the at least one higher frequency acoustic signal dependent on the acoustic characteristics of the surface may comprise delaying at least one of the lower frequency acoustic signal and the at least one higher frequency acoustic signal dependent on the delay between contact conduction and air conduction.

Generating at least one lower frequency audio signal for output by contact conduction via the surface and at least one higher frequency acoustic signal for output by air conduction dependent on determining the apparatus is in contact with the surface may comprise: outputting the higher frequency acoustic signal via a multifunction device membrane to drive an air flow and outputting the lower frequency acoustic signal via a multifunction device mass to vibrate the surface.

Outputting the lower frequency acoustic signal via a multifunction device mass to vibrate the surface may comprise physically coupling the mass to the surface via a compliant surface contact such that the motion of the mass generates vibrations on the surface outputting the lower frequency acoustic signal.

The method may further comprise notch filtering a multifunction device mass resonant frequency from the lower frequency acoustic signal prior to outputting the lower frequency acoustic signal to the multifunction device mass.

Determining when the apparatus loses contact with a surface may comprise at least one of: determining an acoustic coupling; determining an optical sensor output; determining a mechanical coupling sensor output; and determining an electrical coupling sensor output.

The at least one lower frequency acoustic signal is substantially between 0 and 500 Hz.

According to a second aspect there is provided apparatus comprising at least one processor and at least one memory including computer code for one or more programs, the at least one memory and the computer code configured to with the at least one processor cause the apparatus to at least perform: generating by at least one transducer within the apparatus at least one lower frequency acoustic signal for output by a surface when in contact with the apparatus and at least one higher frequency acoustic signal for output by air conduction.

The at least one transducer may include at least two transducers, and generating by at least one transducer within the apparatus at least one lower frequency acoustic signal for output by the surface in contact and at least one higher frequency acoustic signal for output by air conduction may cause the apparatus to perform generating by a first of the at least two transducers within the apparatus at least one lower frequency acoustic signal for output by the surface in contact and by a second of the at least two transducers at least one higher frequency acoustic signal for output by air conduction.

The apparatus may be further caused to perform: determining when the apparatus loses contact with the surface; and generating by the at least one transducer at least one combination frequency acoustic signal for output by air conduction dependent on determining when the apparatus loses contact with the surface.

Generating at least one lower frequency acoustic signal for output by contact conduction via the surface and at least one higher frequency acoustic signal for output by air conduction may further cause the apparatus to perform: low pass filtering an input audio signal to generate the at least one lower frequency acoustic signal; and high pass filtering the input audio signal to generate the at least one higher frequency acoustic signal.

The apparatus may be further caused to perform determining the acoustic characteristics of the surface in contact with the apparatus, and wherein generating at least one lower frequency acoustic signal for output by the surface in contact and at least one higher frequency acoustic signal for output by air conduction may cause the apparatus to perform generating the at least one lower frequency acoustic signal and the at least one higher frequency acoustic signal dependent on the acoustic characteristics of the surface.

Determining the acoustic characteristics of the surface in contact with the apparatus may cause the apparatus to perform determining the delay between contact conduction and air conduction; and wherein determining the acoustic characteristics and generating the at least one lower frequency acoustic signal and the at least one higher frequency acoustic signal dependent on the acoustic characteristics of the surface may cause the apparatus to perform delaying at least one of the lower frequency acoustic signal and the at least one higher frequency acoustic signal dependent on the delay between contact conduction and air conduction.

Generating at least one lower frequency audio signal for output by contact conduction via the surface and at least one higher frequency acoustic signal for output by air conduction dependent on determining the apparatus is in contact with the surface may cause the apparatus to perform: outputting the higher frequency acoustic signal via a multifunction device membrane to drive an air flow and outputting the lower frequency acoustic signal via a multifunction device mass to vibrate the surface.

Outputting the lower frequency acoustic signal via a multifunction device mass to vibrate the surface may cause the apparatus to perform physically coupling the mass to the surface via a compliant surface contact such that the motion of the mass generates vibrations on the surface outputting the lower frequency acoustic signal.

The apparatus may be further caused to perform notch filtering a multifunction device mass resonant frequency from the lower frequency acoustic signal prior to outputting the lower frequency acoustic signal to the multifunction device mass.

Determining when the apparatus loses contact with the surface may further cause the apparatus to perform at least one of: determining an acoustic coupling; determining an optical sensor output; determining a mechanical coupling sensor output; and determining an electrical coupling sensor output.

The at least one lower frequency acoustic signal may be substantially between 0 and 500 Hz.

According to a third aspect there is provided apparatus comprising: means for generating within the apparatus at least one lower frequency acoustic signal for output by a surface when in contact with the apparatus and at least one higher frequency acoustic signal for output by air conduction.

The means for generating may include at least a first transducer means for generating at least one lower frequency acoustic signal for output by the surface in contact and at least a second transducer means for generating a higher frequency acoustic signal for output by air conduction.

The apparatus may further comprise: means for determining when the apparatus loses contact with the surface; and means for generating at least one combination frequency acoustic signal for output by air conduction dependent on determining when the apparatus loses contact with the surface.

The means for generating at least one lower frequency acoustic signal for output by contact conduction via the surface and at least one higher frequency acoustic signal for output by air conduction further may comprise: means for low pass filtering an input audio signal to generate the at least one lower frequency acoustic signal; and means for high pass filtering the input audio signal to generate the at least one higher frequency acoustic signal.

The apparatus may further comprise means for determining the acoustic characteristics of the surface in contact with the apparatus, and wherein the means for generating at least one lower frequency acoustic signal for output by the surface in contact and at least one higher frequency acoustic signal for output by air conduction may comprise means for generating the at least one lower frequency acoustic signal and the at least one higher frequency acoustic signal dependent on the acoustic characteristics of the surface.

The means for determining the acoustic characteristics of the surface in contact with the apparatus may comprise means for determining the delay between contact conduction and air conduction; and wherein the means for generating the at least one lower frequency acoustic signal and the at least one higher frequency acoustic signal dependent on the acoustic characteristics of the surface may comprise means for delaying at least one of the lower frequency acoustic signal and the at least one higher frequency acoustic signal dependent on the delay between contact conduction and air conduction.

The means for generating at least one lower frequency audio signal for output by contact conduction via the surface and at least one higher frequency acoustic signal for output by air conduction dependent on determining the apparatus is in contact with the surface may comprise means for outputting the higher frequency acoustic signal via a multifunction device membrane to drive an air flow and outputting the lower frequency acoustic signal via a multifunction device mass to vibrate the surface.

The means for outputting the lower frequency acoustic signal via a multifunction device mass to vibrate the surface may comprise means for physically coupling the mass to the surface via a compliant surface contact such that the motion of the mass generates vibrations on the surface outputting the lower frequency acoustic signal.

The apparatus may further comprise means for notch filtering a multifunction device mass resonant frequency from the lower frequency acoustic signal prior to outputting the lower frequency acoustic signal to the multifunction device mass.

The means for determining when the apparatus loses contact with the surface further may comprise at least one of: means for determining an acoustic coupling; means for determining an optical sensor output; means for determining a mechanical coupling sensor output; and means for determining an electrical coupling sensor output.

The at least one lower frequency acoustic signal may be substantially between 0 and 500 Hz.

According to a fourth aspect there is provided apparatus comprising: at least one transducer configured to generate at least one lower frequency acoustic signal for output by a surface when in contact with the apparatus and at least one higher frequency acoustic signal for output by air conduction.

The at least one transducer may include at least one first transducer configured to generate the at least one lower frequency acoustic signal for output by the surface in contact and at least one second transducer configured to generate at least one higher frequency acoustic signal for output by air conduction.

The apparatus may comprise a contact determiner configured to determine when the apparatus loses contact with the surface, and the transducer may be configured to generate at least one combination frequency acoustic signal for output by air conduction dependent on determining the apparatus is free from the surface.

The transducer may comprise: a low pass filter configured to filter an input audio signal to generate the at least one lower frequency acoustic signal; and a high pass filter configured to high pass filter the input audio signal to generate the at least one higher frequency acoustic signal.

The apparatus may further comprise an acoustic analyser configured to determine the acoustic characteristics of the surface in contact with the apparatus, and wherein the transducer is configured to generate the at least one lower frequency acoustic signal and the at least one higher frequency acoustic signal dependent on the acoustic characteristics of the surface.

The acoustic analyser may comprise a delay estimator configured to determine the delay between contact conduction and air conduction; and the transducer is configured delay at least one of the lower frequency acoustic signal and the at least one higher frequency acoustic signal dependent on the delay between contact conduction and air conduction.

The transducer may comprise a multifunction device membrane configured to drive an air flow for outputting the higher frequency acoustic signal and a multifunction device mass to vibrate the surface for outputting the lower frequency acoustic signal via.

The apparatus may comprise a compliant surface contact configured to physically couple the mass to the surface such that the motion of the mass generates vibrations on the surface outputting the lower frequency acoustic signal.

The apparatus may further comprise a notch filter configured to notch filter a multifunction device mass resonant frequency from the lower frequency acoustic signal prior to outputting the lower frequency acoustic signal to the multifunction device mass.

The surface contact determiner may comprise at least one of: an acoustic coupling determiner; an optical sensor; a mechanical coupling sensor; and an electrical coupling sensor.

The at least one lower frequency acoustic signal may be substantially between 0 and 500 Hz.

A computer program product stored on a medium may cause an apparatus to perform the method as described herein.

An electronic device may comprise apparatus as described herein.

BRIEF DESCRIPTION OF THE DRAWINGS

For a better understanding of the present application and as to how the same may be carried into effect, reference will now be made by way of example to the accompanying drawings in which.

DETAILED DESCRIPTION OF EMBODIMENTS OF THE INVENTION

Figure 1:
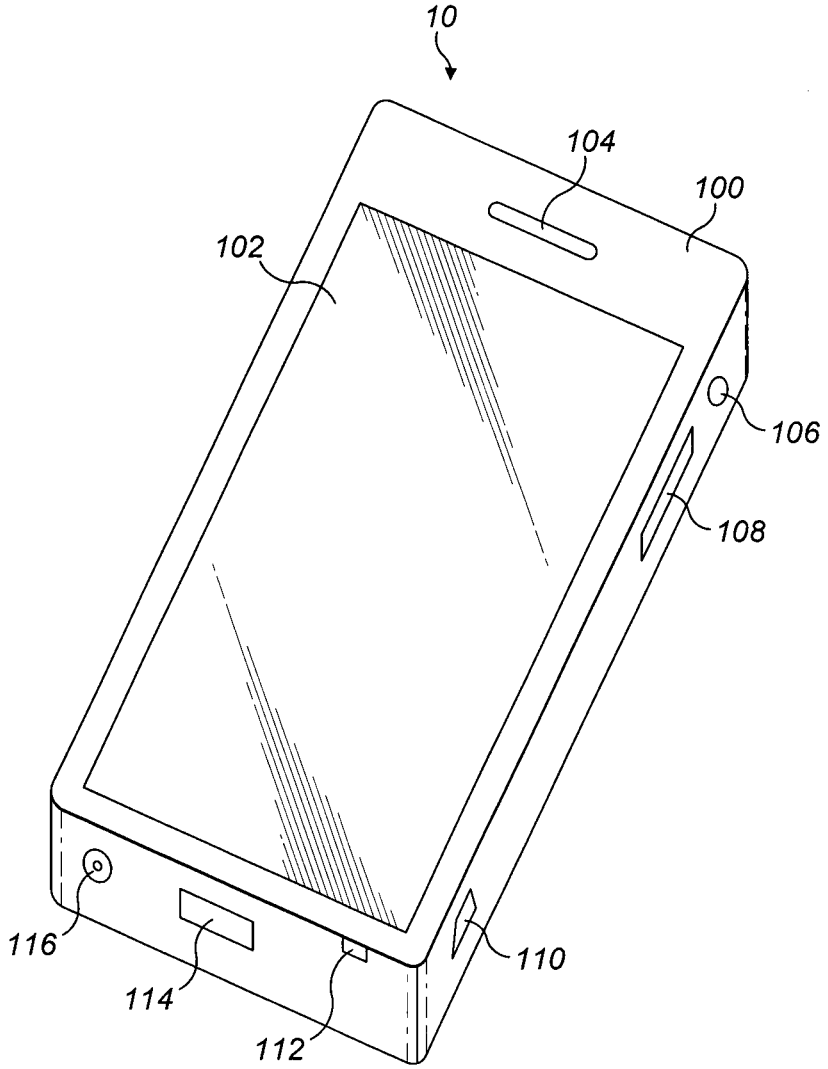
FIG. 1 shows schematically an electronic device apparatus employing embodiments.

The following describes in further detail suitable apparatus and possible mechanisms for an illustration of an example system comprising the known solution for a sound generating system. The apparatus as shown in FIG. 1 is an equipment in the form of a mobile phone. However it would be appreciated at embodiments of the application may be implemented with any devices containing a transducer which may be a speaker module or a vibra mechanism. In other embodiments it may be an electronic device such as a music player or a wireless communication system, for example, a mobile telephone, a smartphone, a PDA, a computer, a music player, a video player, or any other type of device adapted to output an audio signal.

The audio signal, such as a music signal, can as described herein be suitably processed using digital signal processing (DSP) together with an audio amplifier before the multi-function device (MFD). The higher frequencies of the audio signal can in some embodiments as described herein be generated by the normal sound generation functionality of the MFD. The lower frequencies in some embodiments as described herein drive the spring loaded magnet and produce vibrations which are transmitted from the mobile device to an external surface/object in order to produce low frequency sound via the external surface/object. It is understood that higher frequencies drive the membrane to produce sound and lower frequencies drive the spring loaded magnet for generating vibrations.

In an example embodiment, the audio signal such as a music signal, can in some embodiments as described herein be processed in such a way that an equalizer, which in some embodiments can include a notch filter reduces the vibration resonance of the MFD which may comprise an high Q-factor resonance. It is known that an MED with a narrow vibration resonance may not sound well. A multi-band dynamic range controller (DRC) in some embodiments could process the audio signal in order to boost the energy of quieter frequencies in a low frequency band. For example, a DRC band is applied for the lower frequency band aggressively whereas an alternative DRC band could be designed softer for the upper frequency band.

It is known that the MFD for a portable device could be designed with either open back or closed back. It is understood that its resonance will change relative to open or close back configurations. Where the MFD is configured with a closed back cavity inside the apparatus, the MFD's vibra resonance could occur in a range between 0 Hz to 500 Hz. If MFD is configured with an open back, then its resonance could occur in a range between 400 Hz and 1.2 kHz. A known MFD could have a very narrow vibration resonance (high q-factor) at around 157 Hz in order to generate a good vibration performance.

In some embodiments, the vibrations and the air conduction generated by the MFD should be in phase. It is important to make sure that the mechanism could suitably add sound pressure at the crossover frequency range where both the magnet and the membrane of the MFD will operate in phase.

The mobile phone 10 may in some embodiments comprise an outer cover 100 which houses some internal components. The outer cover may comprise a display region 102 through which a display panel is visible to a user. The outer cover in some embodiments comprises a sound aperture 104. In these embodiments the sound aperture 104 may further include a separate bezel for the sound aperture 104 or in some other embodiments may be formed as part of the outer cover 100 or the display region 102. When the sound aperture 104 is placed adjacent to a user's ear, sound generated by an earpiece module (not shown) is audible to the user. The mobile phone 10 may further comprise a volume control button 108 with which the user can control the volume of an output of the speaker modules. The mobile phone 10 comprises at least one sound outlet 114 which may be used to radiate sound waves generated by a speaker module (not shown). The speaker module may be a loudspeaker and in some embodiments the loudspeaker can be a multi-function-device (MFD) comprising a vibra functionality wherein an electronic signal is converted into a vibration. The MFD component having any of the following: combined earpiece, integrated handsfree speaker, vibration generation means or a combination thereof. In further embodiments the mobile phone 10 comprises a separate vibra module in order to provide a vibra functionality. It is understood that the vibra functionality is configured to vibrate the housing of the mobile phone 10.

The speaker module may be used for handsfree operations such as music playback, ringtones, handsfree speech and/or video call. The sound outlet 114 couples the acoustic output of the speaker module to exterior of the mobile phone 10. In some embodiments, the sound outlet 114 may comprise a suitable mesh structure or grill which may take various forms, shapes or materials and which may be designed in relation to the frequency response of the speaker module 114. The sound outlet 114 may be structured as an array of individual small openings or may be a single cross section area. The sound outlet 114 may be rectangular or cylindrical or may be any other suitable shape. At least one microphone outlet 112 for a microphone module (not shown) may be suitably positioned in mobile phone 10 to capture the acoustic waves by at least one microphone and output the acoustic waves as electrical signals representing audio or speech signals which then may be processed and transmitted to other devices or stored for later playback.

The mobile phone 10 may provide interfaces enabling the user to interface external devices or equipment to the mobile phone 10. For example an audio connector outlet 106 may be suitably positioned in the mobile phone 10. In some embodiments, the audio connector outlet may be substantially hidden behind a suitably arranged door or lid. The audio connector outlet 106 may be suitable for connection with an audio connector (not shown) or may be suitable for connection with an audio or audio/visual (AN) connector. The audio connector provides releasable connection with audio or A/V plugs (not shown). These plugs provide an end-termination for cabling and are used to connect a peripheral device to the mobile phone 10. In this way, the mobile phone 10 is able to output audio or A/V and receive audio or A/V input. Such audio or A/V plugs are often called round standard connectors and may be in different formats which may comprise at least two contacts. The external device such as a headset may itself comprise a microphone or suitable connection for a microphone or further connection suitable for end terminating further cabling. The audio connector and/or associated plug may be a standardized 2.5 mm or 3.5 mm audio connector and plug. It is accordingly understood the audio connector outlet 106 may be formed comprising a suitably arranged cross section area.

The mobile phone 10 may further comprise in some embodiments a universal serial bus (USB) interface outlet 110. The USB interface outlet 110 is suitably arranged for a USB connector (not shown). The mobile phone 10 may further require a charging, operation and therefore comprise a charging connector 116. The charging connector 116 may be of various sizes, shapes and combinations or in some embodiments can be visually or substantially hidden.

Figure 2:
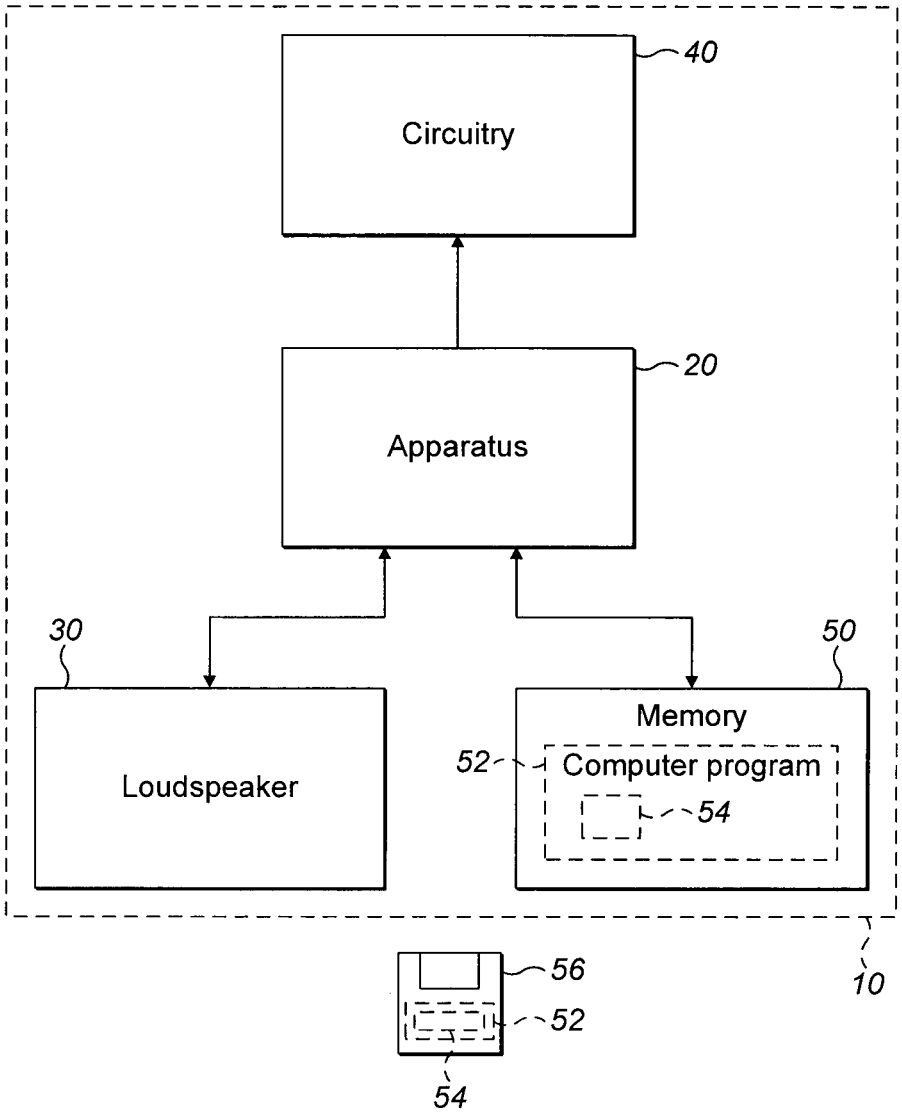
FIG. 2 shows schematically the electronic device shown in FIG. 1 in further detail.

In FIG. 2, a schematic block diagram of the exemplary mobile phone 10 according to some embodiments is explained in further detail. The mobile phone 10 comprises a processing circuitry 20. The processing circuitry 20 and the loudspeaker 30 are operationally coupled and any number or combination of intervening elements can exist between them (including no intervening elements). The processing circuitry 20 is configured to output a suitable electrical signal to the loudspeaker 30 to generate acoustic signals. The electrical signal can in some embodiments be a first component of an electrical audio signal, where the first component comprises a frequency band of the electrical audio signal comprising one or more frequency components. The loudspeaker 30 is configured to convert the first component into the acoustic signal.

The processing circuitry in some embodiments can output a second component of the electrical audio signal to the loudspeaker 30. In some embodiments, the processing circuitry delivers the second component to a second different transducer, for example a vibra module, providing the vibra function. The second component comprises a low-frequency band of the electrical audio signal. The loudspeaker 30 and/or the second transducer are configured to deliver vibrations to at least one surface of the housing of the mobile phone 10. The acoustic energy and the vibrations are generated from the mobile phone 10 at substantially a same time for a combined delivery result.

The loudspeaker 30 in this example is an air-conduction transducer configured to convert an electrical signal into acoustic energy or sound waves. It is understood that there may be one or more loudspeakers in alternative embodiments. The second transducer in this example is a vibration module, such as a transducer configured to convert an electrical signal into mechanical energy or vibrations. The second transducer can be suitably located inside the housing of the mobile phone 10 to send vibrations to the housing. It is understood that in some embodiments the loudspeaker can comprise the second transducer such as a MFD.

The electronic device 10 also comprises a memory 50, and a circuitry 40.

The processing circuitry 20 is configured to provide electrical outputs to the loudspeaker 30 and receives electrical inputs from the circuitry 40. The processing circuitry may comprise a digital-to-analogue converter (DAC) to the loudspeaker. In some embodiments the loudspeaker may be used as an earpiece module suitable for handset speech call. The mobile phone 10 further comprises at least one microphone and an analogue-to-digital converter (ADC) configured to convert the input analogue audio signals from the at least one microphone into digital audio signals.

The mobile phone 10 may comprise multiple transducer modules that may serve different use cases. An audio connector provides a physical interface to an external module such as a headphone or headset or any suitable audio transducer equipment suitable to output from the DAC. In some embodiments the external modules may connect to the mobile phone 10 wirelessly via a transmitter or transceiver, for example by using a low power radio frequency connection such as Bluetooth A2DP profile. The processor is further linked to a transceiver (TX/RX), to a user interface (UI) and to a memory 22.

The processing circuitry and/or the circuitry may be configured to execute various program codes. The implemented program codes may in some embodiments comprise individual settings for generating suitable audio signals to the loudspeaker 33 and/or the second transducer. The implemented program codes may be stored for example in the memory for retrieval by the circuitry whenever needed. In some embodiments, the codes are adaptively generated suitable for dedicated use cases. The memory 50 could further provide a section for storing data, for example data that has been processed in accordance with the embodiments.

The loudspeaker 30 may comprise one or more magnets and a membrane. At least one of the magnets is an electromagnet. At least one of the magnets (such as the electromagnet) is coupled to the membrane. When an electrical signal is provided to the electromagnet by the processing circuitry 20, attraction and repulsion between the electromagnetic and at least one other magnet causes the membrane to move, which results in sound being produced by the loudspeaker 30.

Implementation of the processing circuitry and/or the circuitry can be in hardware alone (a circuit, a processor . . . ), have certain aspects in software including firmware alone or can be a combination of hardware and software (including firmware).

The processing circuitry and/or the circuitry may be implemented using instructions that enable hardware functionality, for example, by using executable computer program instructions in a general-purpose or special-purpose processor that may be stored on a computer readable storage medium (disk, memory etc) to be executed by such a processor.

The processing circuitry and/or the circuitry configured to read from and to write to the memory 50. The memory 50 is illustrated as storing a computer program 52 comprising computer program instructions 54 that control the aspects of the operation of the electronic device 10 when loaded into the circuitry and/or the processing circuitry. The computer program instructions 52 provide the logic and routines that enables the apparatus 20 to perform the method illustrated in FIG. 5. The circuitry and/or the processing circuitry by reading the memory 50 are able to load and execute the computer program 52.

The computer program 52 may arrive at the electronic device 10 via any suitable delivery mechanism 56. The delivery mechanism 56 may be, for example, a computer-readable storage medium, a computer program product, a memory device, a record medium such as a CD-ROM or DVD, an article of manufacture that tangibly embodies the computer program 52. The delivery mechanism may be a signal configured to reliably transfer the computer program 52. The electronic device 10 may propagate or transmit the computer program 52 as a computer data signal.

Although the memory 50 is illustrated as a single component it may be implemented as one or more separate components some or all of which may be integrated/removable and/or may provide permanent/semi-permanent/dynamic/cached storage.

In some embodiments, the mobile phone 10 includes a first transducer; a second (different from the first) transducer which is a vibration conduction transducer comprising a vibration function; and a crossover connected to the first and second transducers. The crossover is configured to separate an electrical audio signal into a first frequency band component and a second frequency band component. The second frequency band component is at least partially different from the first frequency band component. The apparatus is configured to provide the first component to the first transducer and the second component to the vibration conduction transducer. It is understood that the crossover could be a switch that may be selectively operated. The crossover can be in hardware alone (a circuit, a processor . . . ), have certain aspects in software including firmware alone or can be a combination of hardware and software (including firmware).

Figure 3:
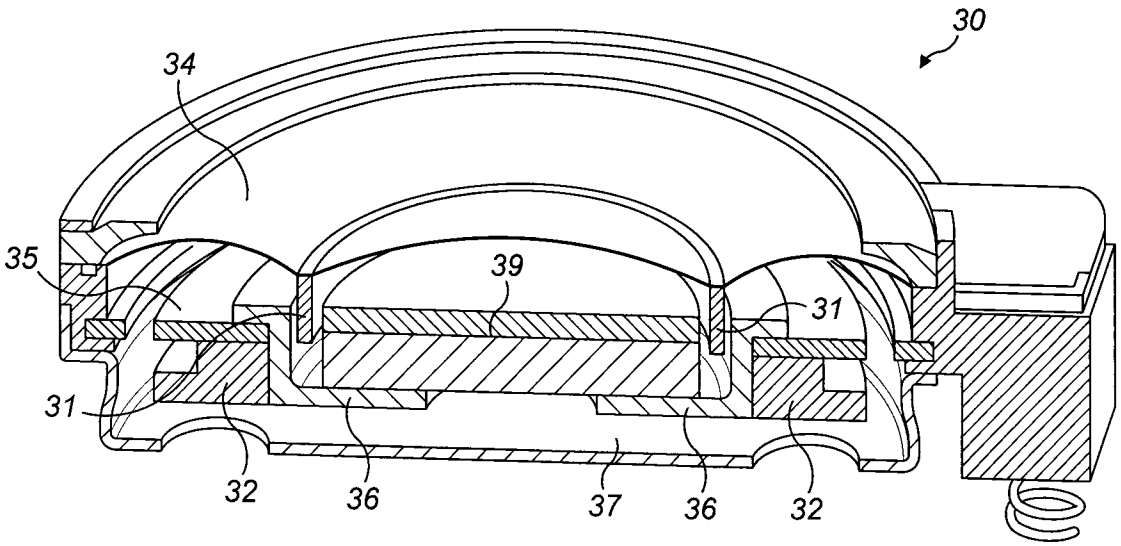
FIG. 3 shows schematically a multi-function device according to some embodiments.

FIG. 3 illustrates an example of a loudspeaker 30 suitable for implementation in some embodiments. In this example, the loudspeaker 30 is a multi-function device. The loudspeaker can in some embodiments operate as an earpiece loudspeaker (for instance, for a mobile telephone) and a hands-free loudspeaker. In some embodiments the loudspeaker can also provide a vibration function for an electronic device (such as a mobile telephone) that the loudspeaker is incorporated into. The loudspeaker 30 comprises a voice coil 31, a mass 32, a membrane 34, a resilient member 35, a coupling member 36 and a permanent magnet 39. In this example, the resilient member 35 is a spring. The mass 32 is coupled to the resilient member 35. The permanent magnet 39 is coupled to the mass 32 and the resilient member 35 via the coupling member 36. The voice coil 31 is attached to the membrane 34.

In this example, the processing circuitry 20 is electrically coupled to the voice coil 31. The voice coil 31 acts as an electromagnet when the processing circuitry 20 provides an electrical drive signal to the voice coil 31. Attraction and repulsion between the permanent magnet 39 and the voice coil 31 cause the permanent magnet 39, the mass 32, the resilient member 35 and the connecting member 35 to move in the space 37 beneath the permanent magnet 39 and the mass 32. The attraction and repulsion between the permanent magnet 39 and the voice coil 31 also causes the voice coil 31 to move. As the voice coil 31 is attached to the membrane 34, the membrane 34 also moves, causing the loudspeaker 30 to emit sound.

Figure 4:
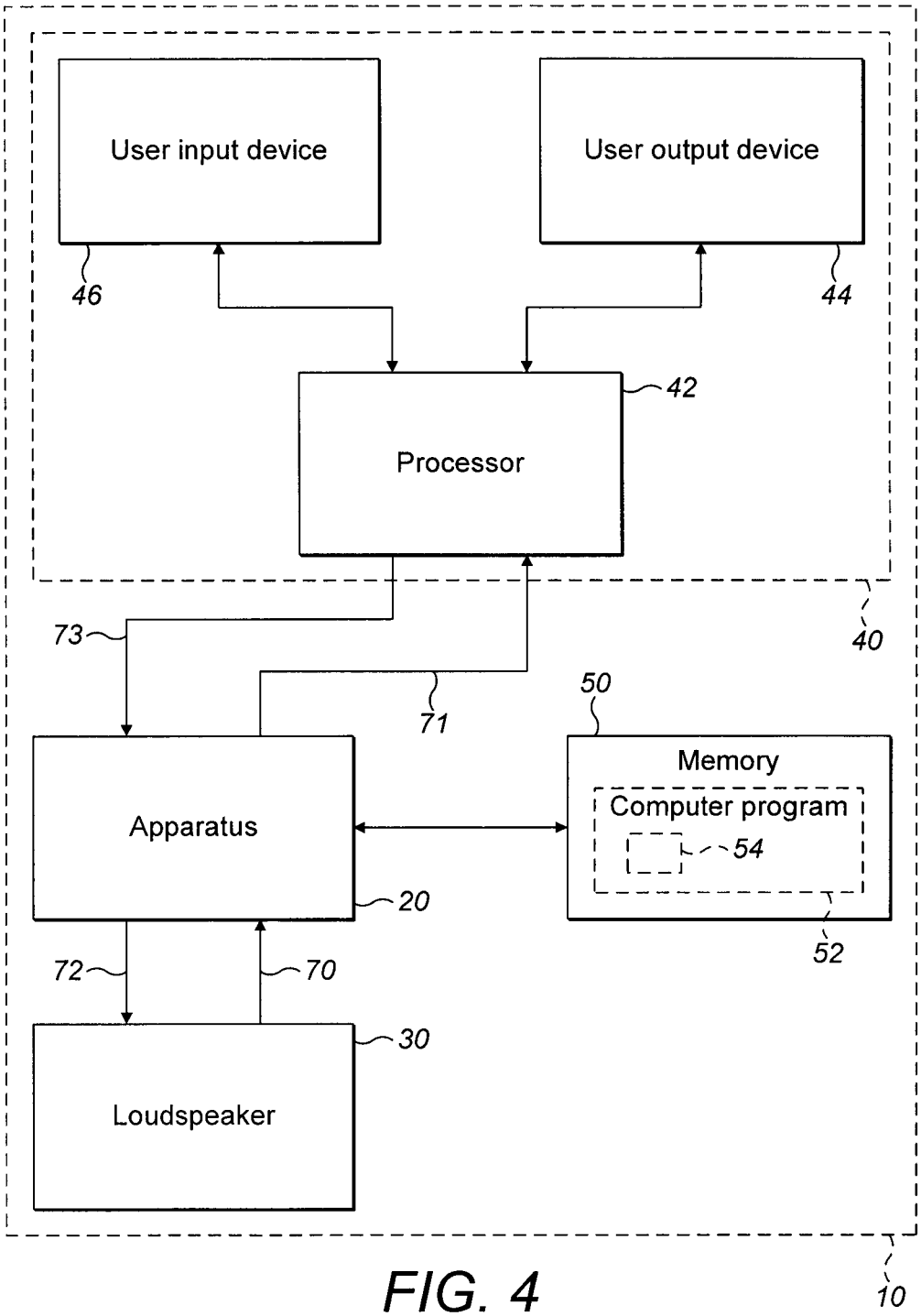
FIG. 4 shows schematically the electronic device according to some embodiments.

FIG. 4 illustrates a more detailed example of the electronic device 10 illustrated in FIG. 2, and in particular shows in further detail the circuitry 40. In this example, the circuitry 40 is provided by a processor 42, a user input device 46 and a user output device 44. The user input device 46 may, for example, be a keypad or display such as a touchscreen display. The user output device 44 may, for example, be a display such as a touchscreen display.

In the example illustrated in FIG. 4, the processor 42 is configured to receive inputs from the user input device 46 and configured to provide outputs to the user output device 44. In some alternative embodiments the processor 42 is configured to receive inputs from at least one of a sensor, an accelerometer, a compass, a microphone etc. The processor 42 is configured to provide a control signal 73 to the processing circuitry 20. In some alternative embodiments, the processor is configured to receive a control signal 71 from the processing circuitry 20. The processor 42 in some embodiments can be a central processor of the electronic device 10 (or include a central processor of the electronic device 10). The processor 42 may perform functions. For example, the processor 42 can in some embodiments be configured to control the user output device 44 to display information.

The processing circuitry 20 is configured in some embodiments to receive a control signal 73 from the processor 42. In response to receiving the control signal 73, the processing circuitry 20 may provide a drive signal 72 to the loudspeaker 30. The drive signal 72 can in some embodiments be configured to drive the loudspeaker 30 to produce sound.

In some alternative embodiments the loudspeaker 30 is configured to provide an electrical output signal 70 to the processing circuitry 20, for example in response to a force or an impedance measurement across the terminals of the loudspeaker 30. When a force is applied to the loudspeaker 30, the permanent magnet 39 and the magnetic field associated with it move. This generates an electric current in the voice coil 31, which is provided as an electrical output signal to the processing circuitry 20. The presence of an electrical output signal 70 from the loudspeaker 30 indicates that the permanent magnet 39 is moving relative to the voice coil 31 and the properties of that electrical signal 70 (for example, the maximum amplitude of the signal 70 and the frequency of the signal 70) indicate the nature of the movement. In some embodiments the presence of the electrical signal 70 configures the processor and/or the processing circuitry to adjust the drive signal 72 for playback operations. For example, when the mobile phone 10 is positioned on a flat surface of external objects, the first and second frequency bands are configured so that the vibrations are sent to at least one surface of the external object from the mobile phone 10 in order to convert vibrations into a second acoustic energy. The acoustic energy can furthermore in some embodiments be extended in response to the first frequency band when the vibrations are converted into the second acoustic energy. It is understood that the first and second acoustic energy can overlap partially or substantially.

In some embodiments, input information can be provided into the electronic device 10 by applying a force to the loudspeaker 30. The force may be applied directly to the loudspeaker 30, or indirectly via the application of a force to some other part of the electronic device 10 that is coupled to the loudspeaker 30.

In order to prevent the application of any force to the electronic device 10 being interpreted as a user based input, the apparatus 20 may process the electrical output signal 70 to detect whether a user input signal is present. For example, the processing circuitry 20 may detect a user input signal by determining that the electrical output signal 70 provided by the loudspeaker 30 has at least one characteristic associated with user input.

In response to determining that an electrical output signal 70 provided by the loudspeaker 30 has the at least one characteristic associated with a user input, the processing circuitry 20 may provide a control signal to circuitry 40 modified from the input signal received from the loudspeaker 30. The control signal 71 can for example be configured to cause the circuitry 40 to perform a function.

In some embodiments as represented in this particular example, the processing circuitry 20 can be configured to provide a control signal 71 to the processor 42, in response to determining that an electrical output signal 70 provided by the loudspeaker 30 has the at least one characteristic. The control signal 71 can be configured to cause the processor 42 to perform a function. For example, in response to receiving the control signal 71, the processor 42 may control the user output device 44 to display information so that the user can configure desired settings manually. In alternative embodiments, the electrical output signal 70 provided by the loudspeaker 30 can be provided to the processor 42 by other means either manually or automatically. For example, the user can manually initiate the use case when the mobile phone 10 is suitably positioned against a surface of an external object. Alternatively in some embodiments a sensor signal or an impedance measurement for the loudspeaker 30 can determine when the mobile phone is positioned against a flat surface of an external object.

Figure 5:
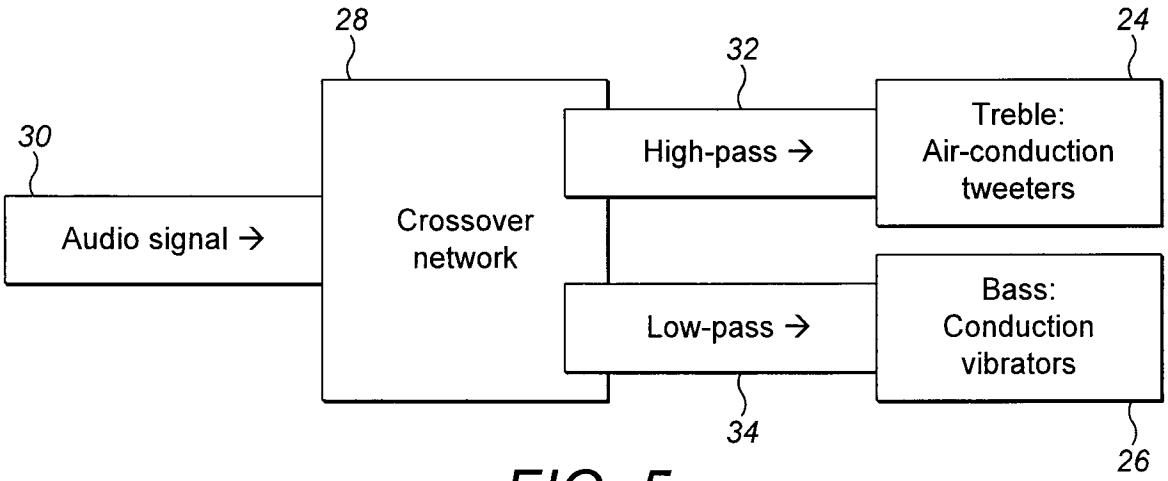
FIG. 5 shows a crossover network suitable for implementing in the electronic device according to some embodiments.

Referring to FIG. 5, in some embodiments the processing circuitry 20 can include an audio crossover or crossover network 28. The crossover 28 is configured to process the incoming audio signal from the source into frequency bands that can be routed based on the use case. For example, in some embodiments when the mobile phone 10 is positioned in free space (in other words not against a surface of an external object) the crossover 28 is configured to output a first frequency band component 32 but when the mobile phone 10 is positioned against a surface of an external surface then the crossover 28 can be configured to output both a first frequency band component 32 and a second frequency band component 34. In some embodiments, the crossover 28 can be replaced by any suitable filtering and routing apparatus or may not be present. In some embodiments, more than two outputs could be provided. In some such embodiments the output comprising the first component 32 can be connected to an input of the first transducer(s) 24. The output comprising the second component 34 can furthermore in some embodiments be connected to an input of the second transducer(s) 26 which could be separate vibration transducer.

The crossover 28 is in such embodiments configured to filter low-frequencies from the electrical audio signal 30 and form the first component 32 as a frequency band component wherein the loudspeaker 30 operates. The crossover 28 can furthermore be configured to filter high-frequencies from the electrical audio signal 30 and form the second component 34 as a low-frequency band component when a separate vibration transducer is present. In some embodiments, portions of band components 32, 34 might be the same or neighboring frequencies. In such embodiments the loudspeaker 30 can be used for generating the acoustic energy in response to the first band and the second transducer can be used for bass wherein the vibrations from the mobile phone 10 are transmitted to the external object and converted into the second acoustic energy for a combined audio delivery result to the user. It is understood that when the loudspeaker 30 is the MFD, the combined audio delivery is achieved similar to the example embodiment wherein the second transducer is present, for example a vibra module, is used.

Figure 6:
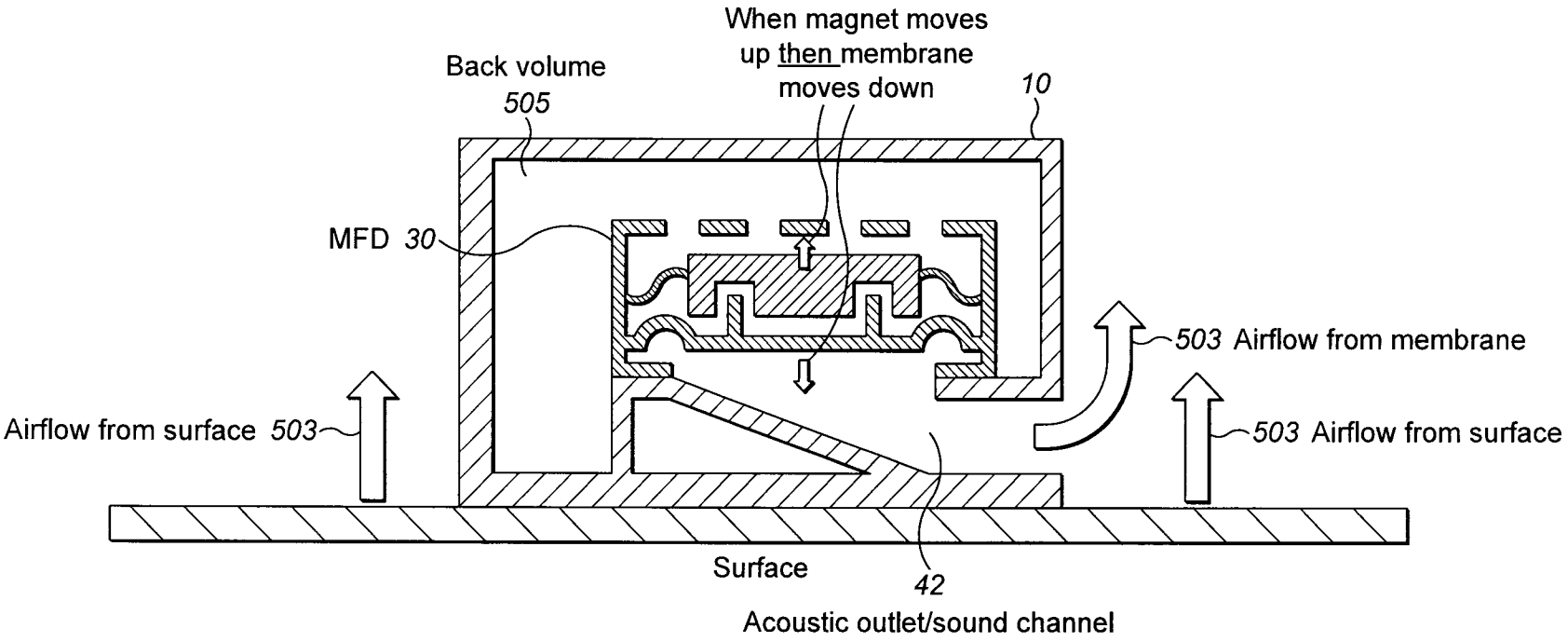
FIG. 6 shows schematically the operation of the multifunction device on a surface.

In some embodiments the crossover or filter is not required and an electrical audio signal passed to the multi-function device transducer which implicitly performs the filtering operation in the transducer to generate the lower and higher frequency acoustic signal outputs. For example as shown in FIG. 6 the signal can be passed to the multi-function device causing the magnet (as the vibrating mass) to move generating the lower frequency acoustic waves as the movement of the apparatus is passed to the surface against which the apparatus is in contact, and the movement of the magnet also causes the membrane to move generating the higher frequency acoustic waves transmitted through the air directly.

Figure 7:
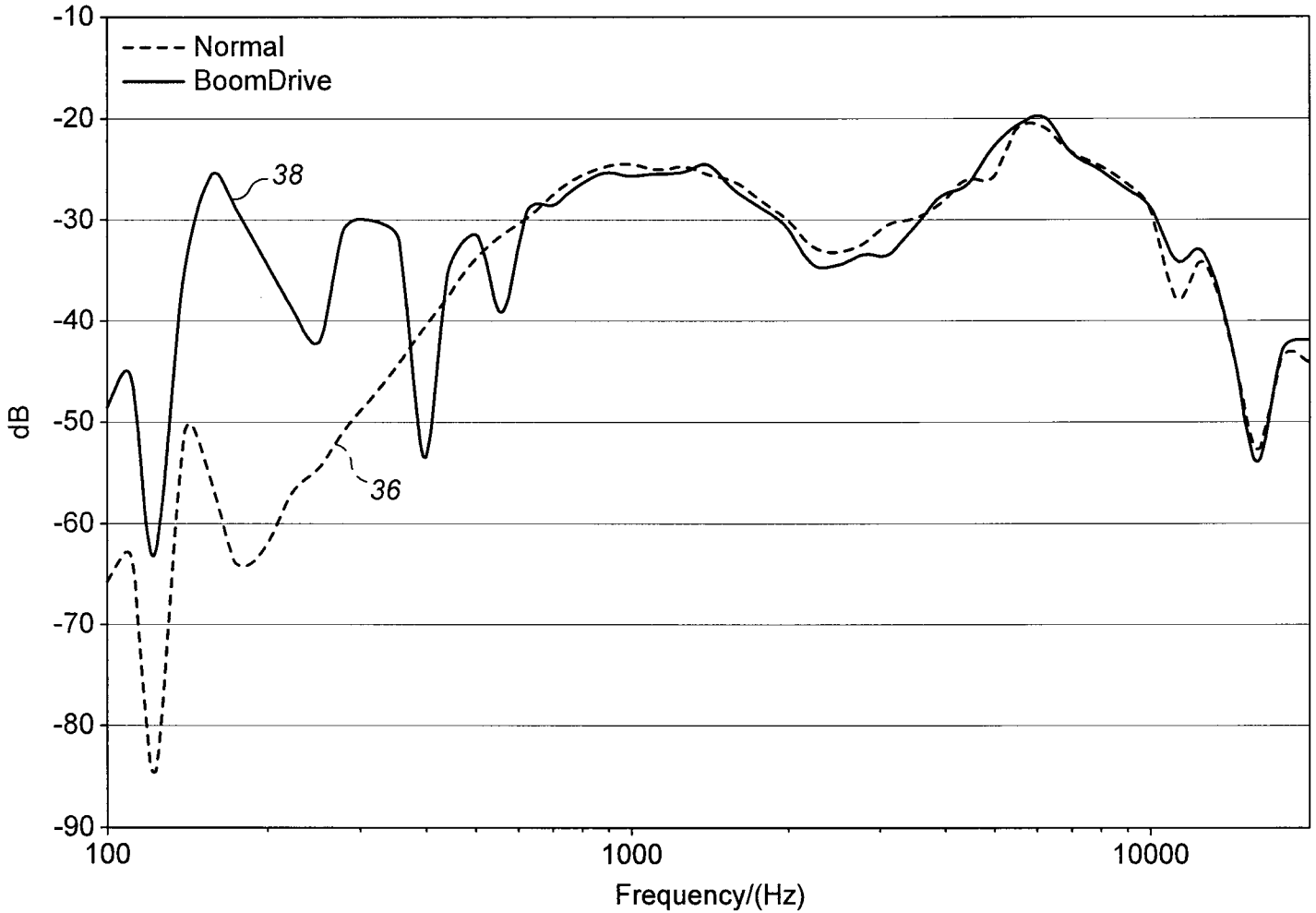
FIG. 7 shows an example spectral output of an embodiment.

Referring to FIG. 7, an example graph is shown of frequency characteristics of sound pressure level for a first situation where the mobile phone 10 is operated in a normal mode (illustrated by line 36) compared against a second situation when the mobile phone 10 is positioned against a surface of an external object (illustrated by line 38). In such examples the loudspeaker 30 could have an input from the crossover 28 as the first component 32 of frequencies of the audio electrical signal 30, and the vibration component 26 could have an input as the second component 34 from the crossover 28 of frequencies of the audio electrical signal 30. The acoustic signals or sound waves from the loudspeaker 30 are radiated. At substantially the same time, the vibrations from the mobile phone 10 are sent to the external object wherein the associated acoustic signals or sound waves are radiated. The two different types of transmissions to the user ear (sound via loudspeaker's membrane and vibrations via the external object) produce a combination or combined resultant delivery of audio information to the user.

The example described above can provide an audio reproduction, and can be provided as a personal system for the delivery of sound. The example described above may present a personalized audio playback to a person by suitably positioning the device against external objects. Unlike conventional audio reproduction, this can permit improved audio playback by using the vibration transmission towards external objects in the user's surrounding environment.

In some embodiments there can be provided a device combining the MFD configured to transmit vibrations and sound waves, which directs low-frequency components of the audio signal to the external objects (where the external objects function for example as woofers), and high-frequency components to the air (functioning for example as tweeters). Vibrations may be deployed (for example) in contact with the external objects such as a box, a table or other suitable surface, wherein a substantially flat surface can be positioned in contact against the device. In some embodiments the output of the low frequency acoustic waves can be sampled or monitored, for example by a microphone or other sensor on the device and the design considerations for different realizations including efficiency of sound generation and/or vibration transmission, comfort, and acoustic cosmetic appearance can be compensated for by comparing the monitored output against a desired response.

In some embodiments electromagnetic dynamic or piezoelectric transducers could be used as air conduction transducers where the vibrations are provided using separate transducers.

In the example embodiment described above the crossover 28 configured to separate low-frequency and high-frequency audio signals is fixed, depending on the choice and configuration of loudspeaker 30, and does not need to be tunable. However, in some embodiments one or more frequency bands can be tunable. The crossover 28 could in some embodiments be realized in the form of discrete analogue components, integrated analogue circuitry, or digital signal processor circuitry.

In one example the low-frequency portion of the audio signal may be tuned for a specific external object. For example the mobile phone or device's sale box wherein the mobile phone can be configured to output the low frequency signal component with pre-determined vibration characteristics associated with the acoustic dynamics of the box.

As noted above, in such embodiments two different types of transmissions to the exterior are provided, these being sound via air conduction due to membrane movement of the loudspeaker 30 and sound via vibrations of a surface of an external object in contact with the device produced by a vibration of the device. In some embodiments the two different types of transmissions can be configured at substantially at the same time. However, in some embodiments the processing circuitry might be configured or programmed to delay transmission of vibrations relative to the first component 32 to compensate for the transmission speed differential of vibration conversion into sound waves via external objects versus air as noted above to thereby synchronize delivery of the two energy forms to the ear to arrive at a substantially same time.

The air-conduction transducers could be electromagnetic dynamic, piezoelectric, electrostatic or thermoacoustic elements for example.

With respect to FIG. 6 a cross-sectional view of some further embodiments. In this example the loudspeaker 30 in the form of multi-function device (MFD) integrated inside the mobile phone 10 and having at least one acoustic outlet suitable for radiating sound waves/air flow towards the exterior. The acoustic outlet 42 is acoustically and/or mechanically coupled to at least one side of the membrane. The acoustic outlet could be designed in such a way that the sound waves from one or both sides of the membrane may be employed in a side-fire configuration. In some embodiments the MFD comprises a back volume 505 suitable for tuning the airflow from the membrane 501 spectral response.

The MFD in some embodiments can be configured to radiate sound waves 501 via its membrane movement which are directed towards the acoustic outlet. Furthermore in some embodiments at substantially the same time, the vibrations produced via the spring mechanism where the mass is controlled for vibrations are transmitted towards a surface of an external object which converts vibrations into sound waves from the surface 503.

In an example embodiment, an electrical audio signal ranging from 20 Hz to 20 kHz is transmitted to the receiver in the circuitry 16, demodulated, pre-amplified, and divided by a crossover network into a bass signal ranging from 50-400 Hz, and a second signal ranging from 300 to 10,000 Hz. The bass or lower frequency signal is input to an audio power amplifier, such as in some embodiments a Class-D audio power amplifier for example, and used to drive one or more vibration transducers (which can effectively function as "woofers"). The second or higher frequency signal is input to an audio power amplifier, such as in some embodiments a Class-D audio power amplifier for example, and used to drive one or more air conduction transducers, such as dynamic or piezoelectric transducers for example (which can effectively function as "tweeters"). This reproduction chain can be provided as shown in this example by using a single transducer in the case of MFD.

One example of intended operation ranges/bandwidths includes 20 Hz to 20 kHz. Low-frequency or lower frequency range response may be extended based upon the type of external objects used. In some embodiments the crossover cut-off frequency for the electrical audio signal may be 300 Hz for example. The cut-off may in some embodiments be adjusted for different configurations of elements such as different materials or air conduction relative to device position against the external object.

Figure 8:
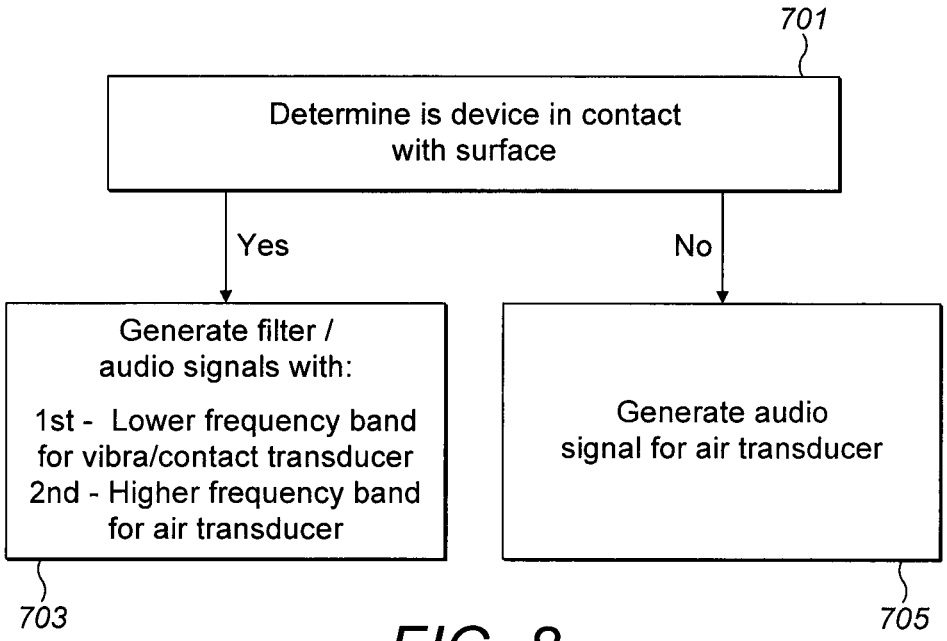
FIG. 8 shows a flow diagram showing the operation of some embodiments.

An example operation of the apparatus or device according to some embodiments is shown with respect to FIG. 8. In some embodiments the apparatus or device is configured to determine whether the device is in contact with a suitable surface. In some embodiments the determination as described herein can be performed by any suitable input. For example in some embodiments a photosensor can be configured to determine when a surface is in contact with the device. In some other embodiments the parameter determined by the audio transducer can be that of determining when the device is in contact with a surface, such as the at least one transducer frequency response when an air seal is made with it indicating the presence of a surface. In some embodiments the surface can include a mechanical coupling such as a lug or plug configured to couple to a socket within the device or vice versa and a mechanical or electrical sensor detecting the coupling. In some embodiments the determination is made manually. In other words the user can switch between a surface contact mode and a 'free standing' mode of operation for example by using a user interface input.

The operation of determining whether the device is in contact with the surface is shown in FIG. 8 by step 701.

In some embodiments when the apparatus or device is determined to be in contact with the surface then the audio signal can be processed such that the audio signal is filtered or separated into at least two frequency bands, a first (lower frequency) band configured to be tuned for output by the vibra or contact transducer and a second (higher frequency) band configured to be tuned for output by the air transducer.

The operation of processing the audio signal to generate the at least two frequency bands for contact and air transducer output is shown in FIG. 8 by step 703.

In some embodiments when the apparatus or device is determined to be in free space or not in contact with a suitable surface (for example when being held) then the audio signal can be processed such that the audio signal is output to the air transducer.

The operation of processing the audio signal to generate the air transducer only output is shown in FIG. 8 by step 705.

A suitable choice in some embodiments for drivers/amplifiers for the vibrations is Class-D audio amplifiers. They deliver good sound quality and offer low power consumption. They may generate electromagnetic interference (EMI) in some design configurations, and that may be addressed in some embodiments by suitable layout and shielding. In some embodiments for air conductors, both Class-G and Class-D audio amplifiers could be employed.

The apparatus may in some embodiments comprise a housing having the loudspeaker 30 connected thereto, where the housing is sized and shaped to be supported on a surface of an external object. The external object may be in the form of a substantially flat surface or a box such as a sale box.

In some embodiments passive amplification of the sound from the loudspeaker is achieved with a horn-shaped structure. In some embodiments the horn-shaped structure comprises a throat portion which widens to a mouth portion. The horn-shaped structure is connected to the sound outlet at a throat of the horn-shaped structure. The horn-shaped structure may be any of the following: a conical horn, an exponentially horn, a tractrix horn or the horn-shaped structure may comprise some characteristics of these types of horn. That is, the horn-shaped structure is substantially horn-shaped and may not be a perfect horn.

The horn-shaped structure may comprise a throat which has a small cross sectional area and the horn-shaped structure flares to a mouth having a larger cross sectional area than the throat. The flaring of the horn-shaped structure means that the sound waves decompress and increase the displacement of the air at the mouth when compared to the throat. The horn-shaped structure provides improved acoustic impedance matching between the loudspeaker and the air. In this way, amplification of the sound from the loudspeaker is achieved with the horn-shaped structure.

The apparatus in some embodiments is therefore configured to transmit the acoustic energy from the loudspeaker 30 towards the exterior more effectively using its sale box. The apparatus may be sized and shaped such that, when the apparatus is not in contact with the external object (for example the sale box or suitable coupling device) or when the use case is not initiated, the apparatus does not transmit vibrations. The apparatus may further comprise in some embodiments a crossover 28 electrically connected to inputs of the loudspeaker 30, where the crossover is configured to separate the electrical audio signal into the first and second frequency band components, and where the apparatus is configured to deliver the first component to the air-conduction transducer and deliver the second component using vibrations. In some embodiments for example, when the loudspeaker is a suitable multi-function device (MFD) transducer, both the first and second components are achieved using the MFD transducer.

The crossover 28 in some embodiments may be configured to separate or filter a high-frequency band (or higher frequency band) from the electrical audio signal as the first component, where a low-frequency band (or lower frequency band) of the electrical audio signal is removed from the electrical audio signal by the crossover to create the first component.

The crossover 28 may similarly in some embodiments be configured to separate or filter a low frequency band (or lower frequency band) from the electrical audio signal as the second component, where a high-frequency band (or higher frequency band) is filtered from the electrical audio signal by the crossover to create the second component.

The air-conduction and the vibration conduction can in some embodiments be configured to operate independently relative to each other, being dependent merely upon their respective input signals. The apparatus may be configured to deliver both forms of the energies to the exterior at a substantially same time.

Advantageously, the vibrations from the loudspeaker are transmitted to the external object. This increases the efficiency of the passive amplification. In some embodiments, the material and shape of the external object such as the same box is advantageously configured to the apparatus in order to transmit vibrations more effectively. Vibration transmitted to the box which converts vibrations into sound waves is configured to increase the loudness. This arrangement increases the sensitivity across the frequency response of the playback system wherein the increase is not constant across the range of frequency components. In an exemplary embodiment, the acoustic performance of the box acts as an acoustic filter to very low frequencies which the portable device does not normally operates when generating sound.

Advantageously, at least some parts of the sale box are recycled for other uses which reduce the amount of undesirable waste. This avoids the sale box being thrown away immediately after opening and does not contribute to problems arising from waste disposal. Alternatively, in some embodiments at least some portions of the box is moulded from a plastic material. In other embodiments the material for packaging comprises one or more of the following blow moulded materials, cardboard, containerboard, corrugated fibreboard, corrugated plastic, ethylene vinyl alcohol resin, extruded polystyrene foam, foam material, injection moulded materials, low density polyethylene, liquid packaging board, moulded pulp materials, paper, paperboard, plastic material, polyethylene, polypropylene, polystyrene, polyvinylidene chloride, styrene-acrylonitrile resin, unica, and vacuum formed packaging.

In some embodiments the mobile phone comprises a sensor configured to detect that it is being used with the external object. The sensor may comprise a photometer or other type of light sensor configured to detect the ambient light levels. In this way, a processor of the mobile phone is configured to receive a signal from the sensor when the ambient light level has decreased and to receive a signal that the loudspeaker is generating vibrations. In some embodiments there may additionally or alternatively be an accelerometer or other sensor for detecting whether the mobile phone is positioned at a specific position against a surface of an external object. On detection of the specific position of the portable device, one or more sensors may send a signal indicating position information to the processor of the mobile phone. The processor is configured to determine the position of the device from the received signal and adjust digital signal processing accordingly.

In other embodiments there may additionally or alternatively be a sensor monitoring the sound pressure level around the outlet of the speaker of the mobile phone. The sensor may detect changes to the sound pressure level when the device is positioned over an external object because the acoustic impedance varies when the radiation characteristics change. The pressure sensor is configured to send a signal to the processor. The signal may comprise an indication of a change in the sound pressure level around the outlet of the speaker. The processor is configured to determine that the portable device is coupled to the external object and adjust the digital signal processing accordingly.

The processor determines on the basis of information received from one or more sensors that the device is being used with the external object. Alternatively or additionally, the sensor is a proximity sensor for detecting that the integrated speaker of the device is inserted over a substantially a flat surface or its acoustic output is adjacent to the flat surface. Furthermore, the device may be configured to receive user input to specify that the device is being used with the external object. After the processor determines that the device is coupled to the external object, the processor is configured to control the audio signal accordingly. In some embodiments, the processor may be configured to tune the playback of sound for loudness. In this way loudness may be increased further on determination of the device being used with the external object.

Additionally or alternatively, the processor may be configured to modify the sound for quality for better performance. For example, the processor is configured to modify sound generation to tune the sound according to vibrations being transmitted to the external object to be converted into sound waves.

Delivering the first component may comprise filtering the low-frequency band from the electrical audio signal to form the first component. Delivering the second component may comprise filtering the high-frequency band from the electrical audio signal to form the second component. A crossover 28 may separate the high-frequency band from the electrical audio signal to deliver as the first component. Alternatively there may not be any filtering process and the audio signal is provided to the loudspeaker in order to produce sound energy and vibrations.

An example embodiment may comprise a vibration transducer and an air-conduction transducer, typically but not necessarily with both transducers operating in overlapping frequency ranges. Both transducers do not need to interact with each other and the transducers do not need to use mechanical properties of each other. Both transducers do not need to be positioned around the same location.

An example embodiment may be provided as an apparatus comprising a first transducer; a second different transducer comprising a vibration conduction transducer; and a crossover 28 connected to the first and second transducers, where the crossover 28 is configured to separate an electrical audio signal 30 into a first frequency band component 32 and a second frequency band component 34, where the second frequency band component is at least partially different from the first frequency band component, and where the apparatus is configured to provide the first component to the first transducer and the second component to the vibration conduction transducer.

The first transducer may be any suitable air-conduction transducer, and the first frequency band component may comprise a high-frequency band of the electrical audio signal. The second frequency band component may comprise a low-frequency band of the electrical audio signal, where the apparatus is configured to deliver the first and second components to the transceivers at a substantially same time. The apparatus may further comprise a housing having the transducers connected thereto. The apparatus is sized and shaped such that, when the apparatus is in contact with the external objects, the apparatus does reproduce improved sound characteristics.

In such embodiments because the output bandwidth may be controlled during the simultaneous operation, and because the system is able to produce to either of the frequency bands, the playback levels of each conduction types can be controlled. For example, the level of air-conduction playback and/or vibrations may be independently controlled.

Features described above can provide an apparatus which is a portable device, thus, is used for sound reproduction. Furthermore in such embodiments the apparatus can be configured to in some embodiments as described herein deliver the first and second frequency components to the same transducer. In some further embodiments the apparatus or device can be configured to deliver the first and second frequency components to different transducers.

In some embodiments the apparatus is configured such that as it is known that speakers with open a back volumes sound bad because they resonate at a higher frequency such as 1200 Hz and therefore the speaker loses bass frequencies. In such embodiments by implementing a MFD, for open back volume where the vibra function has a range between 400 Hz and 1000 Hz then as the telephone rings, the quality is poor provided the volume is sufficient to alert the user. However in such embodiments when the user listens to music, or makes a IHF Call, by placing the apparatus on a surface the quality sufficiently improves since vibrations would generate lower frequencies.

In other words in some embodiments the vibra resonance could occur at a higher frequency (closer to the speaker frequency), where there is an improvement in loudness because vibrations via an external surface would add onto acoustic energy generated by the speaker functionality therefore an improved loudness is achieved. In close back option, the vibra resonance would in such embodiments be low compared to the speaker resonance therefore the bandwidth is increased but since normal speaker functionality would not produce very low frequency sound, there is a separation between speaker and vibra functionality whereas in open back configuration the operation ranges can overlap, leading to improved loudness.

In some embodiments, transferring vibrations from the apparatus into the external surface is supported by an arrangement in such a way that any suitable material or mechanical arrangement is provided such as localized rubber or foam bumps suitably provided on the apparatus. Alternatively a soft material on a surface of the apparatus is provided so that when the apparatus is in contact with the surface, the vibrations are transmitted by reducing or removing the possibility of device rattling It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variations which fall within the scope of the appended claims.

It shall be appreciated that the term portable device is user equipment. The user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising: generating by at least one transducer within an apparatus at least one lower frequency signal for output by a surface when in contact with the apparatus, wherein the at least one lower frequency signal is converted into at least one lower frequency acoustic signal by the surface, and at least one higher frequency acoustic signal for output by air conduction from the apparatus;

determining one or more characteristics of the surface in contact with the apparatus, and generating the at least one lower frequency acoustic signal and the at least one higher frequency acoustic signal dependent on the determined one or more characteristics of the surface.

2. The method as claimed in claim 1, wherein the at least one transducer is at least two transducers, and generating by a first of the at least two transducers within the apparatus at least one lower frequency acoustic signal for output by the surface in contact and by a second of the at least two transducers at least one higher frequency acoustic signal for output by air conduction from the apparatus.

3. The method as claimed in claim 1, further comprising:

determining when the apparatus is not positioned against the surface; and generating by the at least one transducer at least one combined acoustic signal for output by air conduction dependent on determining when the apparatus is not positioned against the surface.

4. The method as claimed in claim 1, wherein generating at least one lower frequency acoustic signal for output by contact conduction via the surface and at least one higher frequency acoustic signal for output by air conduction comprises: low pass filtering an input audio signal to generate the at least one lower frequency acoustic signal; and high pass filtering the input audio signal to generate the at least one higher frequency acoustic signal.

5. The method as claimed in claim 1, wherein determining the characteristics of the surface in contact with the apparatus comprises determining a delay between contact conduction and air conduction; and wherein determining the characteristics and generating the at least one lower frequency acoustic signal and the at least one higher frequency acoustic signal dependent on the one or more determined characteristics of the surface comprises delaying at least one of the at least one lower frequency acoustic signal and the at least one higher frequency acoustic signal dependent on the delay between contact conduction and air conduction.

6. The method as claimed in claim 1, wherein generating at least one lower frequency audio signal for output by contact conduction via the surface and at least one higher frequency acoustic signal for output by air conduction dependent on determining the apparatus is in contact with the surface comprises: outputting the higher frequency acoustic signal via a multifunction device membrane to drive an air flow and outputting the at least one lower frequency acoustic signal via a multifunction device mass to vibrate the surface.

7. The method as claimed in claim 6, wherein outputting the at least one lower frequency acoustic signal via the multifunction device mass to vibrate the surface comprises physically coupling the multifunction device mass to the surface via a compliant surface contact such that the motion of the multifunction device mass generates vibrations on the surface outputting the at least one lower frequency acoustic signal.

8. The method as claimed in claim 6, further comprising notch filtering a multifunction device mass resonant frequency from the at least one lower frequency acoustic signal prior to outputting the at least one lower frequency acoustic signal to the multifunction device mass.

9. Apparatus comprising:

at least one transducer configured to generate at least one lower frequency signal for output by a surface when in contact with the apparatus and at least one higher frequency acoustic signal for output by air conduction from the apparatus, wherein the at least one lower frequency signal is converted into at least one lower frequency acoustic signal by the surface; and an acoustic analyser configured to determine one or more characteristics of the surface in contact with the apparatus, and wherein the transducer is configured to generate the at least one lower frequency acoustic signal and the at least one higher frequency acoustic signal dependent on the determined one or more characteristics of the surface.

10. The apparatus as claimed in claim 9, wherein the at least one transducer includes at least one first transducer configured to generate the at least one lower frequency acoustic signal for output by the surface in contact and at least one second transducer configured to generate at least one higher frequency acoustic signal for output by air conduction from the apparatus.

11. The apparatus as claimed in claim 9, comprising a contact determiner configured to determine when the apparatus is not positioned against the surface, and wherein the at least one transducer is configured to generate at least one combination acoustic signal for output by air conduction dependent on when the apparatus is not positioned against the surface.

12. The apparatus as claimed in claim 9, wherein the transducer comprises:

a low pass filter configured to filter an input audio signal to generate the at least one lower frequency acoustic signal; and a high pass filter configured to high pass filter the input audio signal to generate the at least one higher frequency acoustic signal.

13. The apparatus as claimed in claim 9, wherein the acoustic analyser comprises a delay estimator configured to determine a delay between contact conduction and air conduction; and the transducer is configured delay at least one of the at least one lower frequency acoustic signal and the at least one higher frequency acoustic signal dependent on the delay between contact conduction and air conduction.

14. The apparatus as claimed in claim 9, wherein the transducer comprises a multifunction device membrane to drive an air flow for outputting the higher frequency acoustic signal from the apparatus and the multifunction device mass to vibrate the surface outputting the at least one lower frequency acoustic signal.

15. The apparatus as claimed in claim 14, wherein the apparatus comprises a compliant surface contact configured to physically couple the multifunction device mass to the surface such that the motion of the multifunction device mass generates vibrations on the surface outputting the at least one lower frequency acoustic signal.

16. The apparatus as claimed in claim 14, further comprising a notch filter configured to notch filter a multifunction device mass resonant frequency from the at least one lower frequency acoustic signal prior to outputting the at least one lower frequency acoustic signal to the multifunction device mass.

17. The apparatus as claimed in claim 11, wherein the surface contact determiner comprises at least one of:

an acoustic coupling determiner;

an optical sensor;

a mechanical coupling sensor; and an electrical coupling sensor.

18. The apparatus as claimed in claim 9, wherein the at least one lower frequency acoustic signal is substantially between 0 and 500 Hz.

19. The method according to claim 1, further comprising receiving a user configured setting; and wherein the at least one of the at least one lower frequency acoustic signal and the at least one higher frequency acoustic signal is generated dependent on the user configured setting.

20. The method according to claim 1, further comprising determining when the apparatus is in contact with the surface; and wherein the at least one of the at least one lower frequency acoustic signal and the at least one higher frequency acoustic signal is generated dependent on the determined contact with the surface.

21. The method according to claim 1, further comprising processing an incoming audio signal into frequency bands, determining the at least one lower frequency acoustic signal and the at least one higher frequency acoustic signal dependent on the frequency bands; and wherein the at least one of the at least one lower frequency acoustic signal and the at least one higher frequency acoustic signal is generated from the frequency bands dependent on at least one of a user configured setting and a determined contact with the surface.

22. The method according to claim 1, wherein the one or more characteristics are determined dependent on pre-determined characteristics of an external object that includes the surface, and wherein the at least one lower frequency acoustic signal is generated dependent on the pre-determined characteristics.

23. The method according to claim 1, further comprising receiving a first input signal corresponding to the at least one lower frequency signal and a second input signal corresponding to the at least one higher frequency signal; and wherein the at least one lower frequency acoustic signal and the at least one higher frequency acoustic signal are generated independently relative to each other dependent on received respective input signals.

24. The apparatus according to claim 9, further comprising a processor for receiving a user configured setting; and wherein the at least one of the at least one lower frequency acoustic signal and the at least one higher frequency acoustic signal is generated dependent on the user configured setting.

25. The apparatus according to claim 9, further comprising a processor for determining when the apparatus is in contact with the surface; and wherein the at least one of the at least one lower frequency acoustic signal and the at least one higher frequency acoustic signal is generated dependent on the determined contact with the surface.

26. The apparatus according to claim 9, further comprising a processor for processing an incoming audio signal into frequency bands, and for determining the at least one lower frequency acoustic signal and the at least one higher frequency acoustic signal dependent on the frequency bands; and wherein the at least one of the at least one lower frequency acoustic signal and the at least one higher frequency acoustic signal is generated from the frequency bands dependent on at least one of a user configured setting and a determined contact with the surface.

27. The apparatus according to claim 9, wherein the one or more characteristics are determined dependent on pre-determined characteristics of an external object that includes the surface, and wherein the at least one lower frequency acoustic signal is generated dependent on the pre-determined characteristics.

28. The apparatus according to claim 9, further comprising a processor for receiving a first input signal corresponding to the at least one lower frequency signal and a second input signal corresponding to the at least one higher frequency signal; and wherein the at least one lower frequency acoustic signal and the at least one higher frequency acoustic signal are generated independently relative to each other dependent on received respective input signals.

29. The apparatus according to claim 9, wherein the apparatus includes contact surfaces for supporting the apparatus in contact with the surface.

* * * * *